US010655402B2

(12) United States Patent
Tandazo et al.

(10) Patent No.: US 10,655,402 B2
(45) Date of Patent: May 19, 2020

(54) ONE-CONNECTOR PENETRATOR SYSTEM ADAPTABLE TO ANY CABLES USED IN ARTIFICIAL LIFT SYSTEM

(71) Applicants: Juan Tandazo, Midland, TX (US); Kelys Mercado, Midland, TX (US)

(72) Inventors: Juan Tandazo, Midland, TX (US); Kelys Mercado, Midland, TX (US)

(73) Assignee: SCK Hydraulic Energy and Services LLC, Houston, TX (US)

( * ) Notice: Subject to any disclaimer, the term of this patent is extended or adjusted under 35 U.S.C. 154(b) by 0 days.

(21) Appl. No.: 16/055,081

(22) Filed: Aug. 4, 2018

(65) Prior Publication Data

US 2020/0040665 A1 Feb. 6, 2020

(51) Int. Cl.

| | |
|---|---|
| ***E21B 17/02*** | (2006.01) |
| ***E21B 33/072*** | (2006.01) |
| ***E21B 33/038*** | (2006.01) |

(52) U.S. Cl.

CPC ..... *E21B 17/026* (2013.01); *E21B 33/072* (2013.01); *E21B 33/0385* (2013.01)

(58) Field of Classification Search

CPC ... E21B 17/026; E21B 33/072; E21B 33/0385

See application file for complete search history.

(56) References Cited

U.S. PATENT DOCUMENTS

2009/0197447 A1* 8/2009 Maeland ..... H01R 13/523 439/191

* cited by examiner

*Primary Examiner* — James G Sayre

(74) *Attorney, Agent, or Firm* — Spradley PLLC; Michael Spradley

(57) ABSTRACT

A one-connector penetrator system that is adaptable to any cables used in artificial lift system is described herein. The one-connector penetrator system can comprise an enclosure and a plurality of seals. The enclosure can have a hollowed interior. The plurality of seals can be housed within the enclosure. The plurality of seals can stabilize a three-phase power cable in a fixed position. The plurality of seals can comprise a first seal, a second seal, and a third seal. The first seal can be placed at the front-end portion of the enclosure. The second seal can be placed within the middle portion of the enclosure. The third seal can be placed at the bottom portion of the enclosure.

10 Claims, 7 Drawing Sheets

ONE-CONNECTOR PENETRATOR SYSTEM ADAPTABLE TO ANY CABLES USED IN ARTIFICIAL LIFT SYSTEM

BACKGROUND

This disclosure relates to a one-connector penetrator system that is adaptable to any cables used in artificial lift system.

During the production of oil or gas on a wellbore, devices such as pumps are operated down hole. A power line can be used to provide power to such devices. Power line can be run from the top of the well and then connected to the device. However, due to vibrations, or moving of components used for the production, power lines can be susceptible to damage. As such it would be useful to have an improved system and method for providing a one-connector penetrator system that is adaptable to any cables used in artificial lift system.

SUMMARY

A one-connector penetrator system that is adaptable to any cables used in artificial lift system is described herein. The one-connector penetrator system can comprise an enclosure and a plurality of seals. The enclosure can have a hollowed interior. The plurality of seals can be housed within the enclosure. The plurality of seals can stabilize a three-phase power cable in a fixed position. The plurality of seals can comprise a first seal, a second seal, and a third seal. The first seal can be placed at the front-end portion of the enclosure. The second seal can be placed within the middle portion of the enclosure. The third seal can be placed at the bottom portion of the enclosure.

DETAILED DESCRIPTION

Described herein is a one-connector penetrator system that is adaptable to any cables used in artificial lift system. The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

Figure 1:
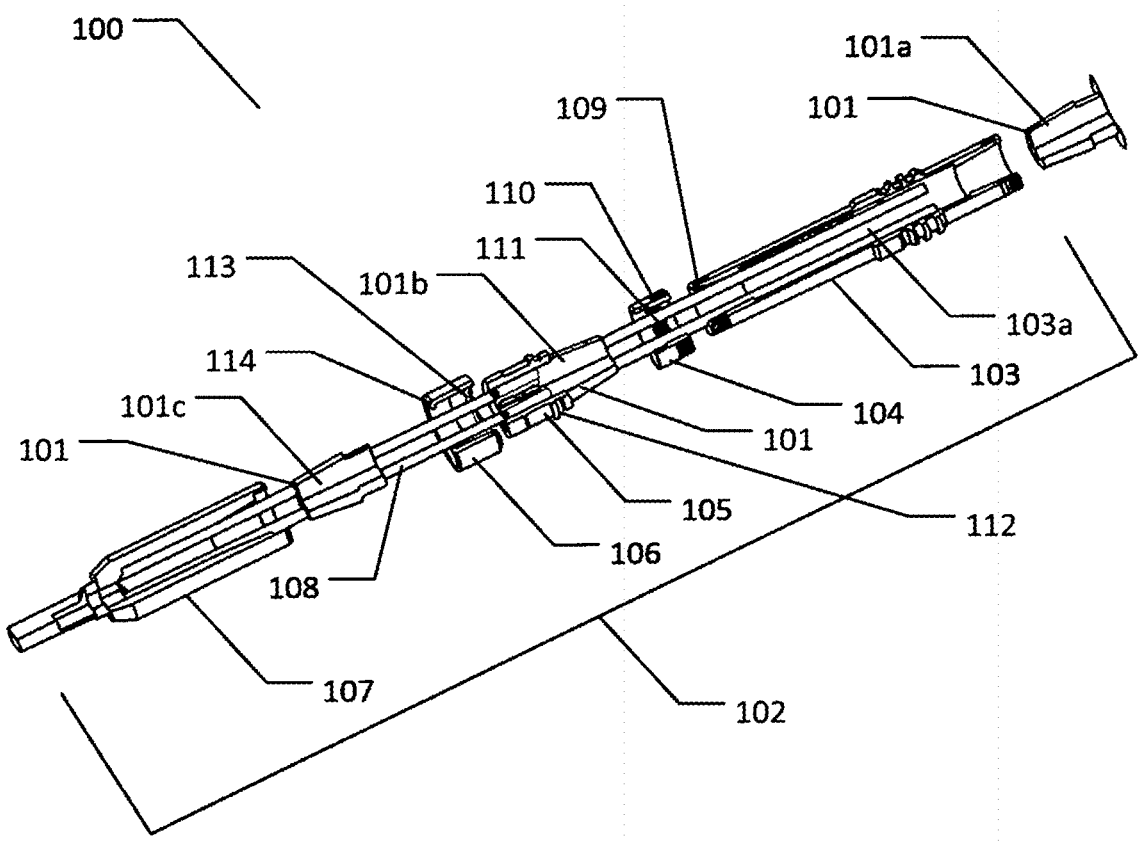
FIG. 1 illustrates an exploded view of one-connector penetrator system.

FIG. 1 illustrates an exploded view of one-connector penetrator system 100. One-connector penetrator system 100 can comprise a plurality of seals 101, and an enclosure 102. One-connector penetrator system 100 can stabilize and protect a three-phase power cable 108 at the wellhead. Moreover, one-connector penetrator system 100 can be adaptable to different types of cable guides used in artificial lift systems with electro-submersible equipment. Thus, one-connector penetrator system 100 can be adaptable to replace existing penetrator systems. As an example, one-connector penetrator system 100 can be adaptable to be used in applications that require the use of Blowout Preventer (BOP Cans). Seals 101 can prevent leakage within one-connector penetrator system 100. Furthermore, seals 101 can be configured in a conical shape that ensures the interior surface of one-connector penetrator system 100 has a constant interior radius. Moreover, seals 101 can stabilize three-phase power cable 108 within one-connector system 100. Seals 101 can be made of elastomer material such as Aflas or HNBR (Hydrogenated Nitrile Butadiene Rubber). Seals 101 can comprise a first seal 101*a*, a second seal 101*b*, and a third seal 101*c*. Enclosure 102 can be a housing having a hollowed interior surface capable of securing the components of one-connector penetrator system 100, such as seals 101 and three-phase power cable 108. Enclosure 102 can comprise a penetrating mandrel 103, a mandrel crossover 104, a conical insurance adapter 105, a crossover adapter 106, and a conic cone 107. Penetrating mandrel 103 can be the top portion of enclosure 102. Penetrating mandrel 103 can comprise an opening 103*a*, and a first outer thread 109. Opening 103*a* can be a hole at the front-end portion of penetrating mandrel 103. A portion of first seal 101*a* can fit snugly within opening 103*a* thus, sealing the front-end portion of enclosure 102. First outer thread 109 can be placed at the rear end exterior surface of penetrating mandrel 103. Second seal 101*b* can fit snugly within the middle interior wall of one-connector penetrator system 100. Mandrel crossover 104 can connect penetrating mandrel 103 with crossover adapter 106. Mandrel crossover 104 can comprise a second outer thread 110 and a first inner thread 111. Conical insurance adapter 105 can connect mandrel crossover 104, crossover adapter 106, and conic cone 107 together. Conical insurance adapter 105 can comprise a plurality of front ridges 112. Front ridges 112 can be protruding portions at the front-end exterior surface of conical insurance adapter 105. Crossover adapter 106 can comprise a second inner thread 113 and a lip 114. Second inner thread 113 can be within the front-end interior surface of crossover adapter 106 while lip 114 can be within the rear end interior surface of crossover adapter 106. Lip 114 can be compatible with the front-end portion of conical insurance adapter 105. Furthermore, crossover adapter 106 can connect penetrating mandrel 103 with conic cone 107. The front-end of conic cone 107 can be compatible with the rear-end portion of conical insurance adapter 105. Thus, conic cone 107 can be positioned at the rear portion of enclosure 102. Conic cone 107 can be adaptable for flat or round electo-immersible power cable. Moreover, conic cone 107 can secure three-phase power cable 108 and convert it to be a single connector.

Figure 2:
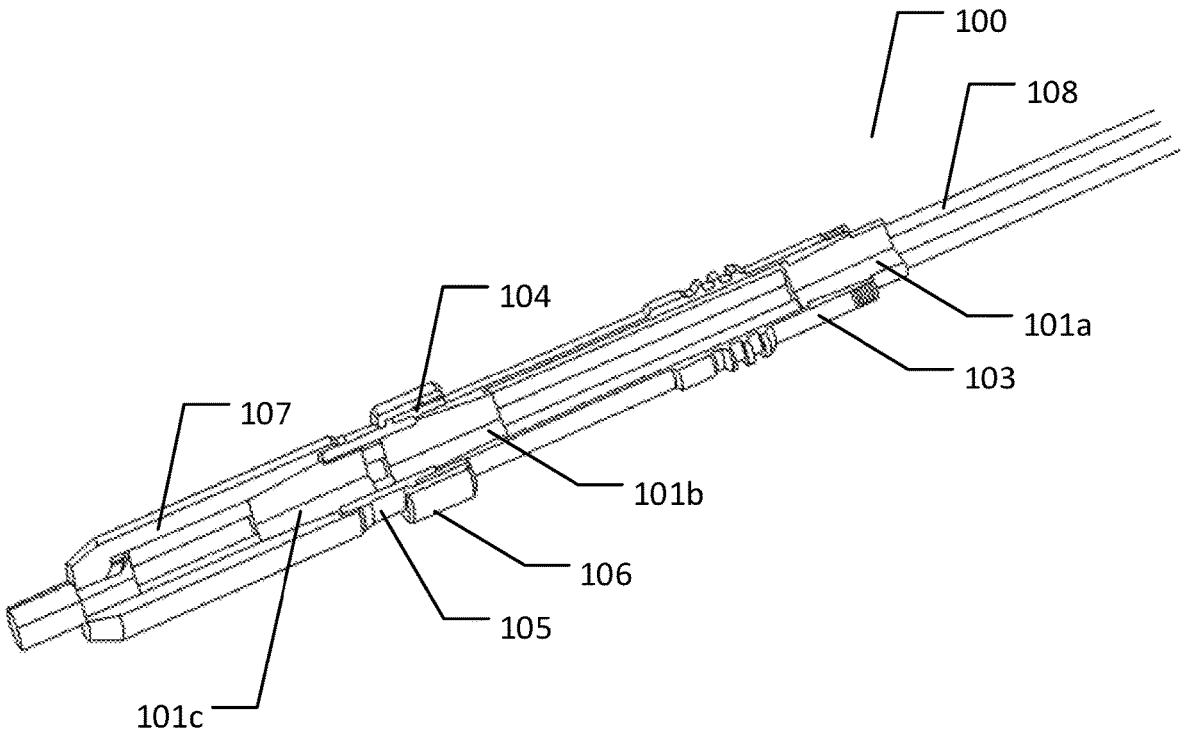
FIG. 2 illustrates a section view of one-connector penetrator system.

FIG. 2 illustrates a section view of one-connector penetrator system 100. The bottom portion of first seal 101*a* can cover the top end portion of penetrating mandrel 103. The rear end of penetrating mandrel 103 can connect with the inner surface of mandrel crossover 104. As such, first outer thread 109 can be mateable with first inner thread 111. Then, crossover adapter 106 can slide towards the front-end outer surface of conical insurance adapter 105. In such structure, lip 114 can snag front ridges 112 of conical insurance adapter 105. The rear end of mandrel crossover 104 can then slide into crossover adapter 106. Once in place, second outer thread 110 can be fastened with second inner thread 113. As such, crossover adapter 106 can attach mandrel crossover 104 and conical insurance adapter 105 together. Second seal 101*b* can be placed within mandrel crossover 104 and conical insurance adapter 105. In such structure, crossover adapter 106 can enclose mandrel crossover 104 and conical insurance adapter 105, and providing compression on second seal 101*b*. The rear end of conical insurance adapter 105 can attach snugly within the front-end of conic cone 107. Third seal 101*c* can be placed at the bottom portion of enclosure 102. As such, conical insurance adapter 105 can compress third seal 101*c* and ensure that power cable 101 is secured at the bottom of one-connector penetrator system 100. In one embodiment, conical insurance adapter 105 can have a compression limit as an abutment within conic cone 107.

Figure 3:
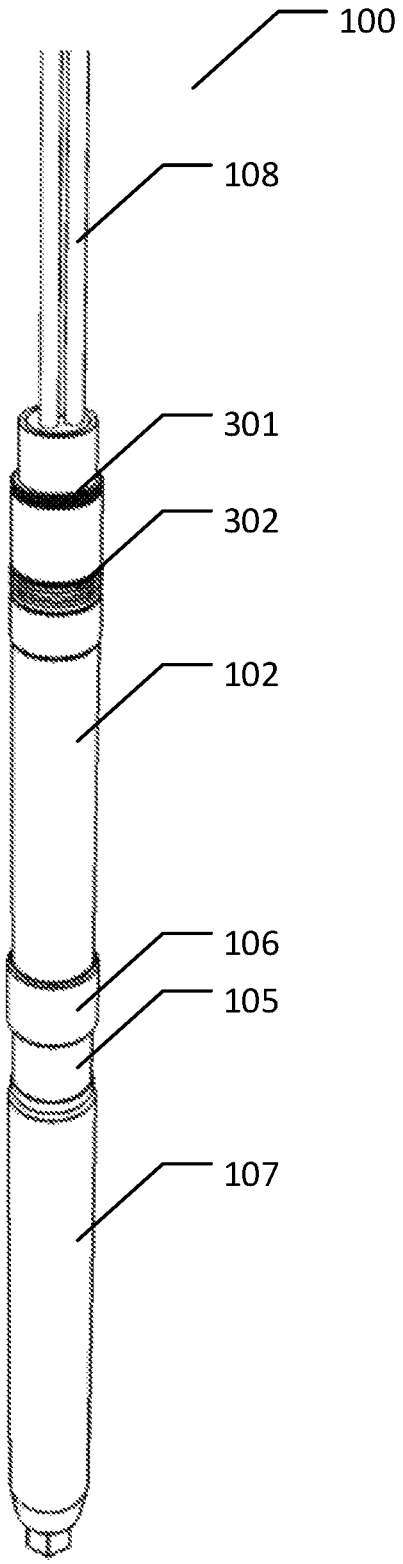
FIG. 3 illustrates a side view of one-connector penetrator system.

FIG. 3 illustrates a side view of one-connector penetrator system 100 comprising penetrating mandrel 103, conical insurance adapter 105, cross over adapter 106, and conic cone 107. The exterior surface of penetrating mandrel 103 can comprise a front outer thread 301, and a plurality of outer ridges 302. Front outer thread 301 can be a threaded portion at the exterior front-end surface of penetrating mandrel 103. Outer ridges 302 can be protruding portion at the exterior surface of penetrating mandrel 103. Furthermore, outer ridges 302 can be placed at the middle exterior surface of penetrating mandrel 103, in between first outer thread 109 and front outer thread 301.

Figure 4:
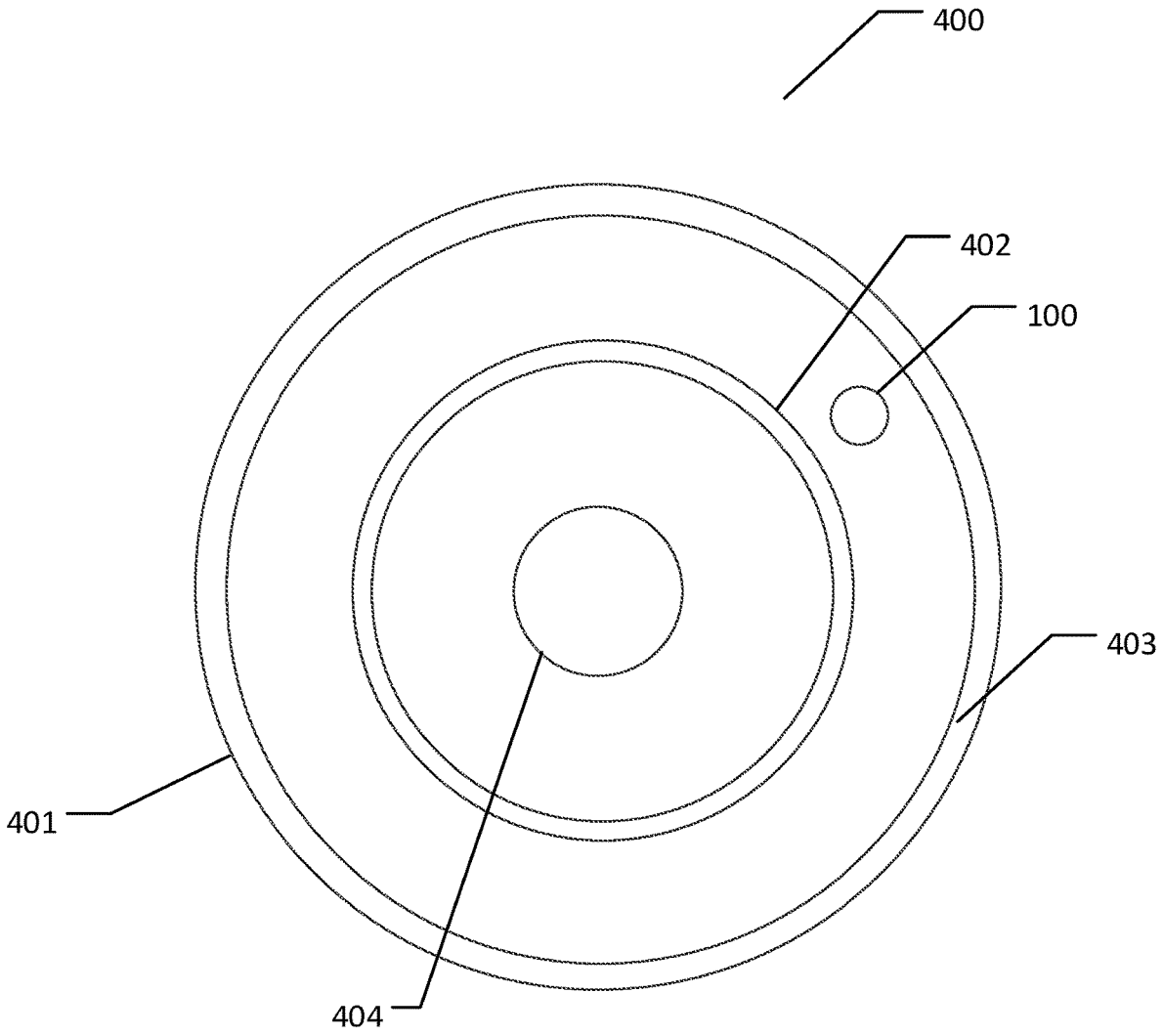
FIG. 4 illustrates a top view of one-connector penetrator system installed within a well.

FIG. 4 illustrates a top view of one-connector penetrator system 100 installed within a well 400. One-connector penetrator system 100 can be installed within well 400 to increase the sealing safety at the wellhead. Well 400 can comprise a casing 401. Casing 401 can comprise an inner wall 402 and an outer wall 403. A production pipe 404 can be installed within inner wall 402 while one-connector penetrator system 100 can be installed within outer wall 403.

Figure 5:
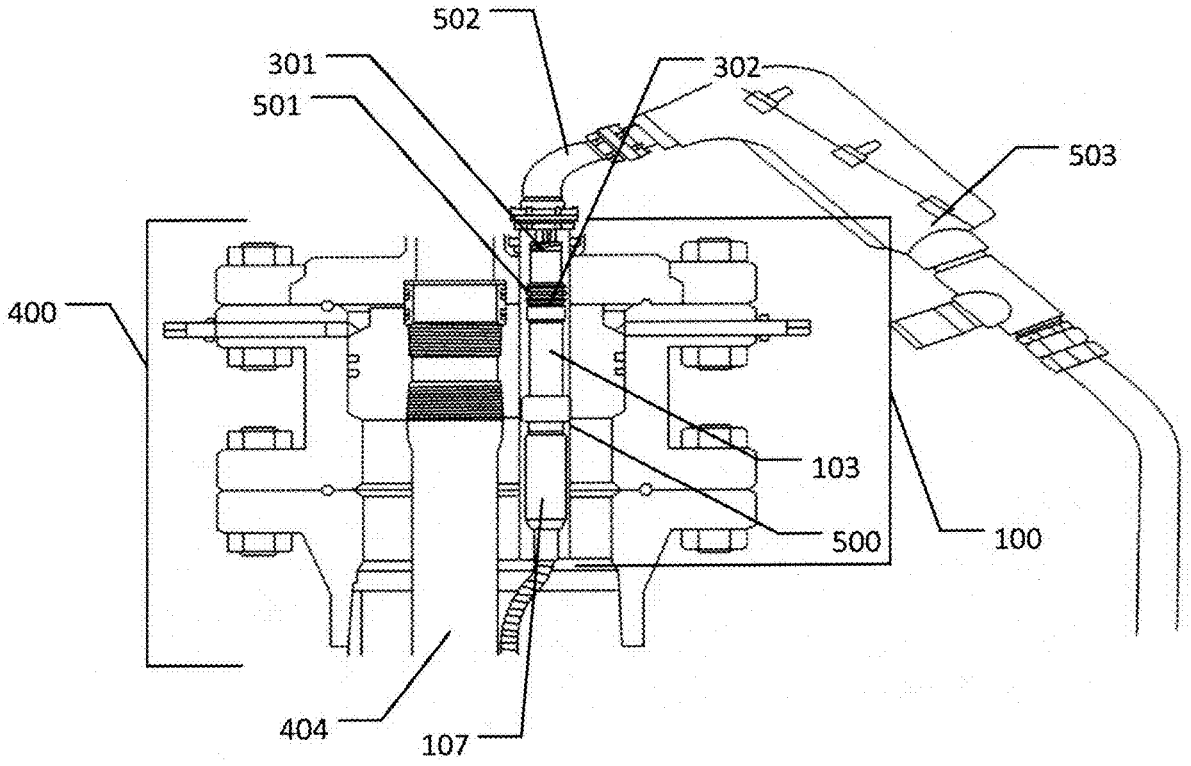
FIG. 5 illustrates a section view of one-connector penetrator system within a well.

FIG. 5 illustrates a section view of one-connector penetrator system 100 within well 400. One-connector penetrator system 100 can be placed within a tubing hanger 500. Tubing hanger 500 can comprise of O-rings 501. O-rings 501 can fit within outer ridges 302 of penetrating mandrel 103. Thus, O-rings 501 and outer ridges 302 can seal the gap between one-connector penetrator system 100 and the inner walls of tubing hanger 500. Further, front outer thread 301 can be mateable with different types of cable guide 502. As an example embodiment shown in FIG. 5, one-connector penetrator system 100 can be connected to a vent box 503 through cable guide 502. Conic cone 107 can enclose three-phase power cable 108 together such that three-phase power cable 108 can form a single device, thus only having a single connector at the bottom of one-connector penetrator system 100.

Figure 6:
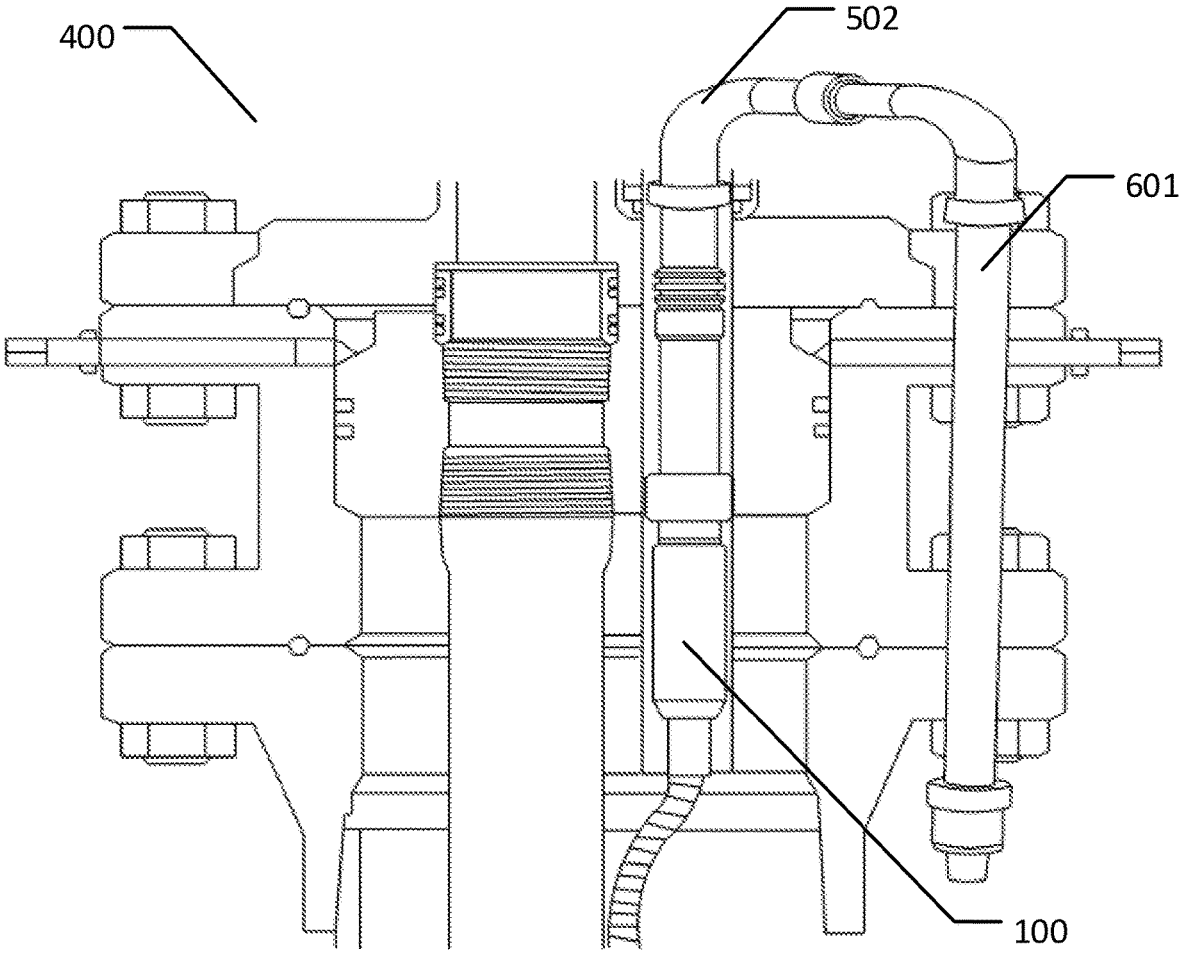
FIG. 6 illustrates a section view embodiment of one-connector penetrator system connected to a power cable electrical splicing through a cable guide.

FIG. 6 illustrates a section view embodiment of one-connector penetrator system 100 connected to a power cable electrical splicing 601 through cable guide 502.

Figure 7:
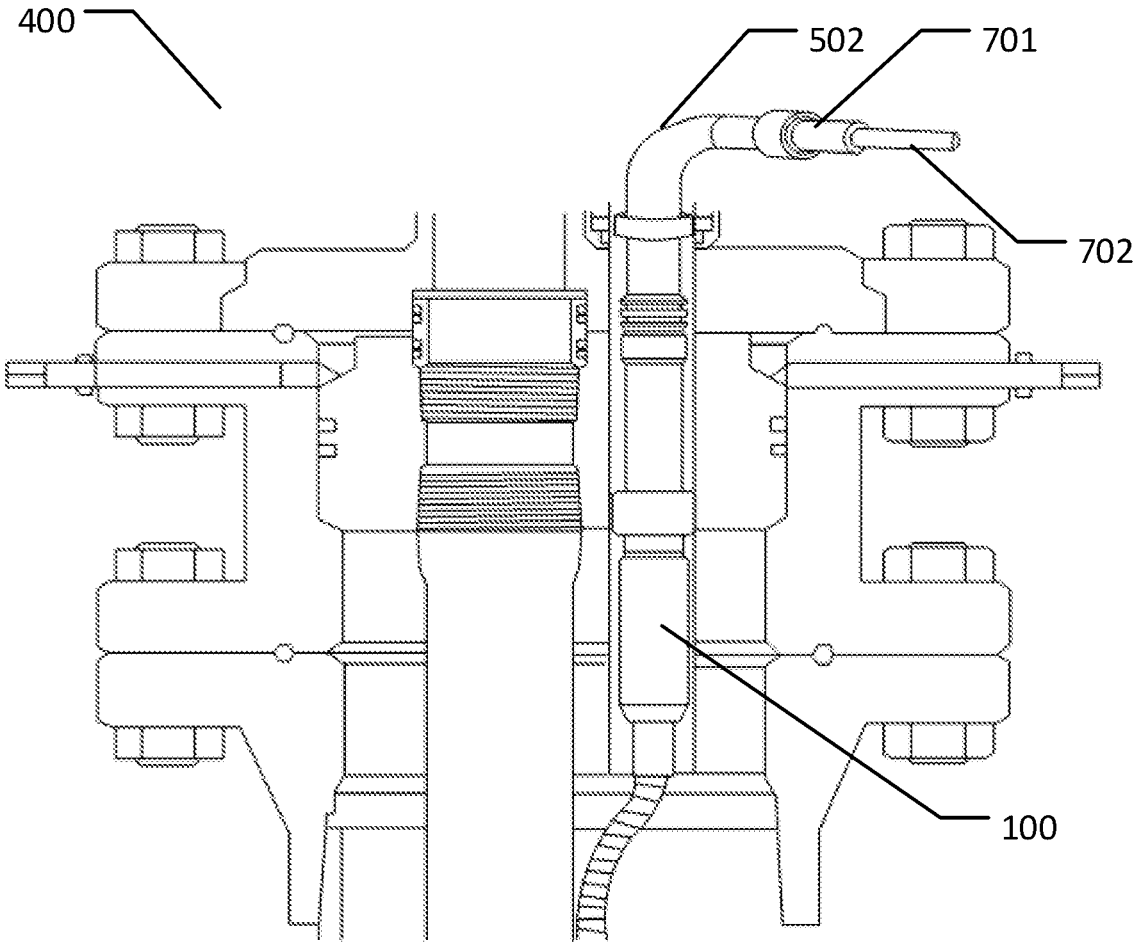
FIG. 7 illustrates a surface-electrical power cable that connects to one-connector penetrator system through a completion cone and cable guide.

FIG. 7 illustrates a surface-electrical power cable 701 that connects to one-connector penetrator system 100 through a completion cone 702 and cable guide 502.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

What is claimed is:

1. A one-connector penetrator system comprising an enclosure having a hollowed interior; and a plurality of seals housed within said enclosure, said plurality of seals capable of stabilizing a three-phase power cable in a fixed position, wherein said plurality of seals comprises a first seal placed at a front-end portion of said enclosure;

a second seal placed within a middle portion of said enclosure; and a third seal placed at a bottom portion of said enclosure;

further wherein said enclosure comprises a penetrating mandrel at the top portion of said enclosure, the front-end portion of said penetrating mandrel houses a portion of said first seal;

a conic cone at the rear end portion of said enclosure, wherein said conic cone receives said three-phase power cable;

a crossover adapter that connects said penetrating mandrel with said conic cone;

a mandrel crossover that connects said penetrating mandrel with said crossover adapter, further wherein said second seal is placed within the interior walls of said mandrel crossover; and a conic insurance adapter that connects said mandrel crossover, said crossover adapter and said conic cone together, further wherein said third seal is placed within the interior walls of said conic insurance adapter.

2. The one-connector penetrator system of claim 1 wherein said penetrating mandrel comprises an opening, said portion of said first seal fits snugly on said opening;

a first outer thread at the rear end exterior surface of said penetrating mandrel, said first outer thread connectable with said mandrel crossover; and a front outer thread at the exterior front-end surface of said penetrating mandrel; and a plurality of outer ridges at the middle exterior surface of said penetrating mandrel.

3. The one-connector penetrator system of claim 2 wherein said front-end outer thread are mateable with different types of cable guide.

4. The one-connector penetrator system of claim 2 wherein said plurality of outer ridges configured to fit O-rings of a tubing hanger.

5. The one-connector penetrator system of claim 1 wherein said mandrel crossover comprises a first inner thread that is mateable with said first outer thread; and a second outer thread connectable with said crossover adapter.

6. The one-connector penetrator system of claim 1 wherein said conical insurance adapter comprises a plurality of front ridges, said plurality of ridges connectable with said crossover adapter.

7. The one-connector penetrator system of claim 6 wherein said crossover adapter slidably connectable at the front-end outer surface of said conical insurance adapter.

8. The one-connector penetrator system of claim 1 wherein said conic cone is adaptable for flat electo-immersible power cable.

9. The one-connector penetrator system of claim 1 wherein said conic cone is adaptable for a round electo-immersible power cable.

10. The one-connector penetrator system of claim 1 wherein each of said plurality of seals are in a conical shape.

* * * * *